United States Patent [19]

Ward

[11] Patent Number: 4,815,172

[45] Date of Patent: Mar. 28, 1989

[54] FASTENING DEVICE

[76] Inventor: Clinton G. Ward, 386 Sackville Street, Toronto, Ontario, Canada, M4V 1S5

[21] Appl. No.: 178,360

[22] Filed: Apr. 6, 1988

[51] Int. Cl.[4] ..... A44B 18/00; B65D 63/00

[52] U.S. Cl. ..... 24/16 R; 24/442

[58] Field of Search ..... 24/16 R, 17 AP, 17 A, 24/17 B, 442, 443, 444, 445, 446, 447, 448, 449, 450, 306; 128/327, DIG. 15; 2/DIG. 6; 248/74.3, 205.2

[56] References Cited

U.S. PATENT DOCUMENTS

| | | | |
|---|---|---|---|
| 3,059,645 | 10/1962 | Hasbrouck et al. | 24/16 PB |
| 3,086,529 | 4/1963 | Munz et al. | 128/327 |
| 3,370,818 | 2/1968 | Perr | 24/442 |
| 3,403,429 | 10/1968 | Smith | 24/442 |
| 3,501,774 | 3/1970 | Norman | 2/DIG. 6 |
| 3,835,505 | 9/1974 | Shewbridge | 24/16 R |
| 4,213,548 | 7/1980 | Wood | 2/DIG. 6 |
| 4,215,687 | 8/1980 | Shaw | 128/DIG. 15 |
| 4,706,914 | 11/1987 | Ground | 24/447 |

*Primary Examiner*—Victor N. Sakran
*Attorney, Agent, or Firm*—Sim & McBurney

[57] ABSTRACT

A fastening device suitable for retaining a power cord, speaker cable, tubing or the like in bundled or coiled form is made of Velcro TM materials. An elongate base strip has one face covered with hooks. Three Velcro TM fastener segments are adhered to the opposite face of the base strip, one segment adjacent to one end of the strip, another segment adjacent to an opposite end of the strip, and an intermediate segment. The intermediate segment and one end segment are formed with complementary hook and fibrous loop fasteners which permit the fastening device itself to be secured, for example, to a power cable. The remaining end segment is formed with fibrous loop fastening material. When the power cable is bundled or coiled, the remaining segment of fibrous loop fastening material is engaged with the hooks covering the opposite face of the base strip at a location which accommodates the size of the bundle or coil to be secured.

5 Claims, 1 Drawing Sheet

FASTENING DEVICE

FIELD OF THE INVENTION

The invention relates generally to fastening devices, and more particularly to devices for securing speaker cables, power cords, tubing or like materials in a bundled or coiled configuration.

BACKGROUND OF THE INVENTION

Cables provided in sound reproduction systems or other electronic systems are often provided in long lengths to accommodate the possible need of an individual to space components of the system by a considerable distance. For example, a long length of speaker cable might be provided to accommodate a potential need to separate a receiver or amplifier some distance from an associated speaker. It is not uncommon to secure the cable in a bundle with a fastener comprising a length of wire concealed between two thin strips of paper, commonly referred to as a "twist-tie". The end user may from time-to-time release the bundle to pay out or drawn in the cable, as speakers are moved. An alternative type of fastener which might be used for such purposes is formed of a single strip of plastic defining a shank have serrated or toothed edges and a slot through which the shank can be inserted and locked to form a loop, the loop being located about the materials to be secured in a bundle or coil. Similar fasteners might be considered for other applications such as securing a coil of garden hose, power cables and the like.

There are several problems with such prior fasteners. First, they tend to be lost when the bundled or coiled materials are released. Second, both types of prior fasteners are difficult to fasten when the relevant diameter of a bundle or coil approaches the length of the fasteners themselves. Fasteners formed with a serrated or toothed shank are particular difficult to manipulate in such circumstances. It would be desirable to provide an alternative fastening device which conveniently overcomes such problems.

BRIEF SUMMARY OF THE INVENTION

In one aspect, the invention provides a fastening device comprising an elongate base strip having a pair of opposing faces. Connection means are associated with the base strip which comprise either hook fasteners and fibrous loop fastening material. For purposes of this specification, the terms "hook fasteners" and "fibrous loop fastening material" should be understood as designating fasteners of the same general type as those commonly known and distributed under the trade mark Velcro TM. These are arranged to permit the base strip itself to be releasably secured to a cable, tube or the like and to permit the base strip to be wrapped about the cable, tube or the like, when bundled or coiled, and secured to itself to retain the materials in bundled or coiled configuration.

In a more specific aspect, the invention provides a fastening device comprising an elongate base strip having a pair of opposing faces. First, second and third connection means extend from one of the opposing faces, the first connection means being attached to the base strip adjacent one end thereof, the second connection means being attached to the base strip adjacent an opposing end, and the third connection means, intermediate the first and second connection means. Fourth connection means extend from the other of the opposing faces. One of the first and third connection means is formed with fibrous loop fastening material and the other with hooked fasteners. One of the second and fourth connection means is formed with fibrous loop fastening material and the other with hooked fasteners. The base strip is formed of a material sufficiently flexible that the first and third connection means can be engaged with one another by hand as to attach the fastening device to a length of cable, conduit or the like and that the second and fourth connection means can then be engaged with one another by hand as to secure the cable, conduit or the like in a bundled or coiled state.

Other aspects of the invention will be apparent from a description of a preferred embodiment below and will be more specifically identified in the appended claims.

DESCRIPTION OF THE DRAWINGS

The invention will be better understood with reference to drawings in which.

DESCRIPTION OF PREFERRED EMBODIMENT

Figure 1:
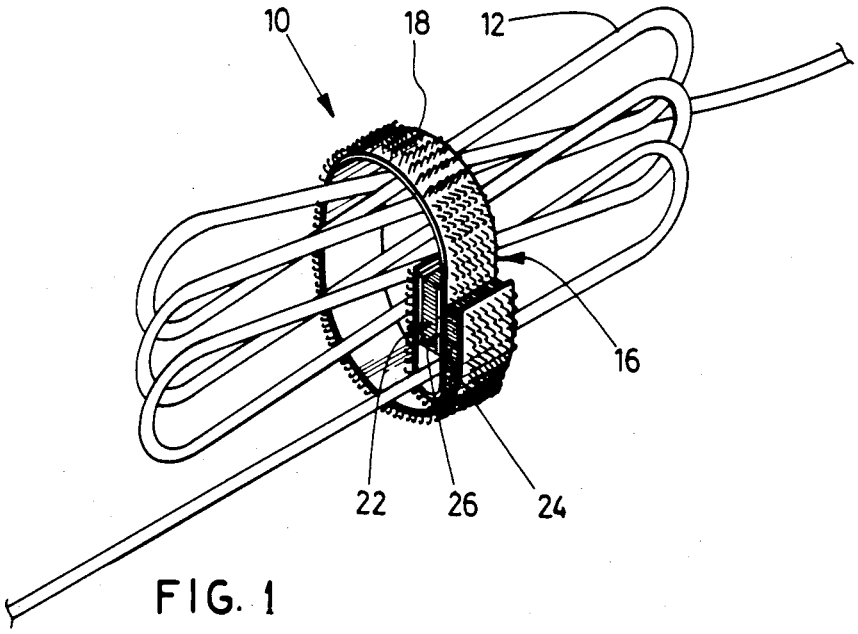
FIG. 1 is a perspective view showing a fastener embodying the invention securing a bundle of cable.

FIG. 1 shows a fastener 10 securing a bundle of cable 12. It should be noted that the fastener 10 would normally be wound more tightly about the cable 12 than has been illustrated. The particular representation has been selected to highlight the manner in which the fastener 10 attaches to the cable 12 and how the fastener 10 maintains the cable 12 in a bundled or coiled form.

Figure 2:
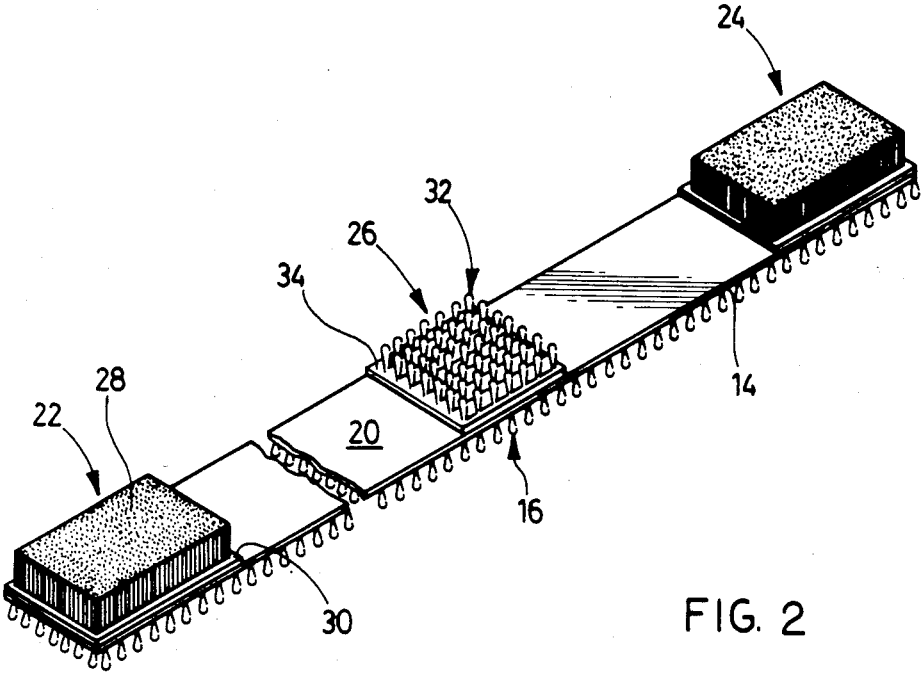
FIG. 2 is a fragmented perspective view providing further detailing the construction of the fastener.

The construction of the fastener 10 is detailed in FIG. 2. It comprises an elongate flexible base strip 14. Hooked fasteners 16 cover the entirety of one face 18 of the base strip 14, and are anchored directly in the base strip 14 and extend away from the one face 18. Each hook is essentially a loop of fairly rigid fibre which has been cut to define a hooking element. The base strip 14 and hooked fasteners 16 are essentially a strip of Velcro TM material.

The opposite face 20 of the base strip 14 is associated with three connectors. A first connector 22 is positioned adjacent one end of the base strip 14; a second connector 24, adjacent an opposing end of the base strip 14, and a third connector 26 intermediate the two connectors 22,24. The first and second connectors 22,24 are formed with a mass of fibrous loop fastening material, and more particularly are cut from standard Velcro TM fastener sheets of this general nature. The first connector 22, which is typical, has fibrous loop fastening material 28 anchored to a base sheet 30. The base sheet 30 is secured to the opposing face 20 of the base strip 14 by means of any appropriate adhesive.

The intermediate or third connector 26 associated with the face 20 of the base strip 14 is formed with hooked fasteners 32. The hooks 32 are anchored into a base sheet 34, and the base sheet 34 is adhesively secured to the face 20 of the base strip 14. The hooks 32 are of course complementary to the fibrous loop fastening material 28 associated with the first connector 22, and serve to form a releasable connection therewith upon engagement in the manner characteristic of Velcro TM fasteners. The intermediate connector 26 is positioned proximate to and spaced a predetermined distance from the first connector 22. This distance corresponds in a very rough manner to the maximum diameter of a cable or tubular member to which the fastener 10 is to be secured. To attached the fastener 10 to the cable 12, the end portion of the base strip 14 bearing the first and third connectors 22,26 can be wrapped by hand about the cable 12 into the configuration illustrated, and the first and third connectors 22,26 engaged to form a releasable joint. This permits the fastener 10 to remain attached at all times to the cable 12, whether the cable 12 is retained in the bundled form or released to pay out or draw in the cable 12. The fastener 10 can, however, be removed by disengaging the first and third connectors 22,26 if use with the cable 12 is no longer required.

The second connector 24 can be releasably engaged by hand with the hooked fasteners 16 extending away form the face 18 of the base strip 14. As apparent in FIG. 1, once the first connector 22 and third connector 26 are fastened to the cable 12, the base strip 14 can be wrapped around the cable bundle and the second connector 24 engaged with the hooked fasteners 16 covering the face 18 of the base strip 14 to releasably secure the bundle. Because hooked fasteners 16 cover the majority of the surface of the face 18 of the base strip 14, the second connector 24 can be fixed to the hook fasteners 16 at various locations. This permits the fastener 10 to conveniently accommodate cable bundles of various size, and permits the fastener 10 to be wrapped without difficulty about bundles or cables whose diameter approaches the length of the base strip 14 itself.

The precise arrangement of hook and fibrous loop fasteners is not critical to the invention. For example, the face 18 of the base strip 14 might be entirely formed with fibrous loop fastening material and the second connector 24, with complementary hook fasteners to permit attachment around a bundle of cable. Similarly, the first and third connectors 22,26 which are used to secure the fastener 10 directly to a cable might have their respective hook and fibrous loop fasteners interchanged. Additional fasteners might be formed, for example, on the face 20 of the base strip 14 to permit attachment of the fastener 10 to cables of different size in a tighter fit, or to reduce the amount of wrapping of the base strip 14 which might be required to encircle a small bundle or coil; however, such measures increase the complexity of the fastener 10 and are not preferred.

The invention also provides a novel method for constructing such fasteners. A number of fasteners substantially identical to the fastener 10 can be produced simultaneously. The starting material is a base sheet of Velcro TM hook fasteners roughly 4 inches by 6 inches which will ultimately define the base strip associated with each of the individual fasteners. Two strips of fibrous loop fastening material are cut having a width of about a ½ inch and a length of about about 4 inches (equal to one side of the hook fastener sheet). A single strip of hooked fastener material is cut having a width about ½ inch and once again a length of about 4 inches. An adhesive is applied to the base material associated with the three fastener strips, and these are then adhered to the smooth surface of the base sheet opposite to the side formed with hooks, parallel to the 4 inch sides of the base sheet with one fibrous loop fastener strip immediately at one 4 inch side of the base sheet and the other fibrous loop fastener strip immediately at the other 4 inch side of the base sheet. The hooked fastener strip is positioned proximate to one of the two fibrous loop fastener strips according to the spacing required between the first and third connectors 22,26 described above. The resulting assembly consists of the base sheet with hook fasteners extending from one face and the three fastener strip extending from the opposite face in parallel, spaced-apart relation. The assembly can then be cut with any appropriate cutting tool at intervals of about ⅜ of an inch perpendicular to the three fastener strips to produce a multiplicity of fasteners similar to the fastener 10 having a width of ⅜ of an inch, a length of 6 inches and three connector segments which are roughly ⅜ of an inch by ½ inch. The various dimensions may of course be altered to produce fasteners of different overall dimensions for different applications. It will be appreciated that hook and fibrous loop fasteners may be interchanged during assembly as has been suggested above.

To facilitate production, the three fastener strips may be positioned at predetermined locations on a first support plate with the associated base strips exposed for receipt of an adhesive. The base sheet comprising the hooked fasteners may be located in a predetermined position on a second support plate preferably hinged to the first support plate. The second support plate may have a surface formed with fibrous loop fasteners to ensure that the base sheet is not displaced once properly positioned. Once the adhesive has been applied to the three fastener strips, the second support plate may be rotated towards the first plate about the hinge joint to engage the smooth face of the base sheet with the adhesively coated surfaces of the three base strips. The support plates may then be left in a closed orientation until the adhesive is set and the plates then opened. The resulting assembly can then be cut as described above to produce the individual fasteners.

The fastener 10 described herein will be seen to overcome disadvantages associated with more conventional cable fastening means. First, the fastener 10 can be releasably attached to wire or cable to prevent loss of the fastener 10 when the wire or cable is released. Second, the fastener 10 can be very conveniently wrapped and secured about a bundle of wire and cable even if the diameter of the wrapped bundle approaches the very length of the fastener 10 itself.

It will be appreciated that particular embodiments of the invention have been described and that modifications may be made therein without departing from the spirit of the invention and without necessarily departing from the scope of the appended claims. In particular, none of the specific applications for such fasteners which are mentioned herein should be viewed as restricting the scope of the invention.

I claim:

1. A fastening device comprising:

an elongate base strip having a pair of opposing faces;

first, second and third connection means extending from one of the opposing faces, the first connection means being attached to the base strip adjacent one end of the strip, the second connection means being attached to the base strip adjacent an opposing end of the base strip, and the third connection means being attached to the base strip intermediate the first and second connection means;

fourth connection means extending from the other of the opposing faces and covering the majority of the other face;

one of the first and third connection means being formed with fibrous loop fastening material and the other of the first and third connection means being formed with hook fasteners;

one of the second and fourth connection means being formed with fibrous loop fastening material and the other of the second and fourth connection means being formed with hook fasteners;

the base strip being formed of a material sufficiently flexible that the first and third connection means can be engaged with one another by hand and that the second and fourth connection means can be engaged with one another by hand at various selectable locations along the other face of the base strip when the first and third connection means are engaged.

2. A fastening device as claimed in claim 1 in which the fourth connection means comprise hook fasteners anchored to the base strip and in which the second connection means comprise a base sheet and fibrous loop fastening material anchored to the base sheet, the base sheet being adhesively secured to the one face of the base strip.

3. A fastening device as claimed in claim 2 in which each of the first and third connection means comprise a base sheet and one of hook fasteners and fibrous loop fastening material anchored to the base material, the base sheets of the first and third connectors being adhesively secured to the one face of the base strip.

4. A fastening device comprising:

an elongate base strip having a pair of opposing faces;

first hook fasteners covering the majority of one of the opposing faces;

first fibrous loop fastening material covering a portion of the other of the opposing faces of the base strip adjacent one end of the base strip;

second hook fasteners covering another portion of the other of the opposing faces of the base strip;

second fibrous loop fastening material covering another portion of the other of the opposing faces of the base strip;

one of the second hook fasteners and the second fibrous loop fastening material being positioned adjacent an opposing end of the base strip and the other of the second hook fasteners and second fibrous loop fastening material being positioned intermediate the one of the second hook fasteners and second fibrous loop fastening material and the first fibrous loop fastening material;

the base strip being formed of a material sufficiently flexible that the second hook fasteners and the second fibrous loop fastening material can be engaged with one another by hand and that the first hook fasteners and the first fibrous loop fastening material can then be engaged with one another by hand at various locations along the one face of the strip.

5. A fastening device as claimed in claim 4 in which:

the first fastener hooks are anchored directly to the base strip;

the first fibrous loop fastening material, the second hook fasteners and the second fibrous loop fastening material are anchored to base sheets, the base sheets being adhesively secured to the other face of the base strip.

* * * * *